US010084244B1

(12) United States Patent
Chang

(10) Patent No.: US 10,084,244 B1
(45) Date of Patent: Sep. 25, 2018

(54) CABLE CONNECTOR ASSEMBLY

(71) Applicant: LOTES CO., LTD, Keelung (TW)

(72) Inventor: Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/831,796

(22) Filed: Dec. 5, 2017

(30) Foreign Application Priority Data

May 19, 2017 (CN) ..... 2017 1 0358883

(51) Int. Cl.

| | |
|---|---|
| ***H01R 13/6592*** | (2011.01) |
| ***H01R 13/6585*** | (2011.01) |
| ***H01R 4/02*** | (2006.01) |
| ***H01R 12/59*** | (2011.01) |
| ***H01R 13/6582*** | (2011.01) |
| ***H01R 13/506*** | (2006.01) |
| *H01R 107/00* | (2006.01) |

(52) U.S. Cl.
CPC ..... *H01R 4/023* (2013.01); *H01R 12/598* (2013.01); *H01R 13/506* (2013.01); *H01R 13/6582* (2013.01); *H01R 2107/00* (2013.01)

(58) Field of Classification Search
CPC ..... H01R 13/6592; H01R 2103/00; H01R 13/658; H01R 24/40
USPC ..... 439/579, 578, 607.05
See application file for complete search history.

(56) References Cited

U.S. PATENT DOCUMENTS

| | | | | |
|---|---|---|---|---|
| 5,679,008 | A * | 10/1997 | Takahashi | H01R 9/0515 439/497 |
| 5,718,607 | A * | 2/1998 | Murphy | H01R 9/038 439/579 |
| 6,210,230 | B1 * | 4/2001 | Lai | H01R 9/0518 439/101 |
| 7,192,301 | B2 * | 3/2007 | Kuroda | H01R 9/032 439/497 |
| 7,637,779 | B2 * | 12/2009 | Nagata | H01R 12/598 439/497 |
| 9,859,659 | B2 * | 1/2018 | Resendez | H01R 13/648 |
| 2004/0127098 | A1 * | 7/2004 | Kuo | H01R 13/6585 439/607.01 |
| 2005/0075009 | A1 * | 4/2005 | Ko | H01R 9/035 439/579 |

(Continued)

FOREIGN PATENT DOCUMENTS

| | | |
|---|---|---|
| CN | 204424609 U | 6/2015 |
| CN | 105556759 A | 5/2016 |

*Primary Examiner* — Gary Paumen
(74) *Attorney, Agent, or Firm* — Locke Lord LLP; Tim Tingkang Xia, Esq.

(57) ABSTRACT

A cable connector assembly, including: a body; a signal terminal and a non-signal terminal accommodated in the body, the signal terminal having a first wire-bonding end extending outside the body, and the non-signal terminal having a second wire-bonding end extending outside the body; a shielding sheet provided on the body, and having a soldering portion extending outside the body; a signal cable having a first core laser soldered to the first wire-bonding end, and a shielding layer wrapping on the first core and electrically connected with the soldering portion to form a contact area; and a non-signal cable having a second core and a second insulating layer wrapping on the second core. A front end of the contact area is flush with a rear end of the second insulating layer or is located behind it.

17 Claims, 13 Drawing Sheets

(56) References Cited

U.S. PATENT DOCUMENTS

2011/0293227 A1* 12/2011 Wu ..... G02B 6/3817
385/101
2015/0214672 A1* 7/2015 Wu ..... H01R 12/775
439/579

* cited by examiner

A–A

B-B

C–C

CABLE CONNECTOR ASSEMBLY

CROSS-REFERENCE TO RELATED APPLICATION

This non-provisional application claims priority to and the benefit of, pursuant to 35 U.S.C. § 119(a), Patent Application Serial No. 201710358883.7 filed in P.R. China on May 19, 2017, the entire content of which is hereby incorporated by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE INVENTION

The present invention relates to a cable connector assembly, and in particular to a cable connector assembly in which terminals are directly soldered to cables.

BACKGROUND OF THE INVENTION

A conventional cable connector assembly includes an insulating body, multiple terminals arranged in the insulating body, a shielding sheet arranged between the terminals, a metal shell wrapping the insulating body, and multiple cables. Each cable has a core, and the cables include at least one coaxial cable and at least one non-coaxial cable. In order to achieve a good grounding effect, a person skilled in the art solders a shielding layer of the coaxial cable to the shielding sheet. Since conventional tin-soldering is time consuming, in order to increase the efficiency of soldering, laser soldering is usually adopted as the soldering method. However, high temperature generated by laser soldering can easily lead to deformation or melting of an insulating layer of the non-coaxial cable adjacent to the shielding layer, affecting its insulating effect, or even leading to exposure of the wire of the non-coaxial cable which is supposed to be wrapped by the insulating layer, resulting in the risks of short-circuiting or electrical leakage.

Therefore, a heretofore unaddressed need to design a new cable connector assembly exists in the art to address the aforementioned deficiencies and inadequacies.

SUMMARY OF THE INVENTION

An objective of the present invention is to provide a cable connector assembly in which a coaxial cable and a non-coaxial cable is arranged side by side, and when they are fixed by laser soldering, the insulating layer therebetween is not damaged, thus ensuring its insulating effect.

To achieve the foregoing objective, one aspect of the invention provides a cable connector assembly, which includes: a body; a plurality of terminals, comprising: a signal terminal having a first wire-bonding end extending outside the body; and a non-signal terminal having a second wire-bonding end extending outside the body along a same direction as the first wire-bonding end; a shielding sheet, provided on the body, and having a soldering portion extending outside the body along the same direction as the first wire-bonding end; a signal cable, having a first core, a first insulating layer wrapping on the first core, and a shielding layer wrapping on the first insulating layer, wherein the first core has a first soldering portion exposed from the first insulating layer and configured to be soldered to the first wire-bonding end, and the shielding layer is electrically connected with the soldering portion to form a contact area; and a non-signal cable, having a second core and a second insulating layer wrapping on the second core, wherein the second core has a second soldering portion exposed from the second insulating layer and configured to be soldered to the second wire-bonding end, and in an extending direction of the soldering portion, a front end of the contact area is flush with a rear end of the second insulating layer or is located behind the rear end of the second insulating layer.

In certain embodiments, a third insulating layer wraps on the shielding layer, and a rear end of the third insulating layer is flush with the rear end of the second insulating layer or is located in front of the rear end of the second insulating layer.

In certain embodiments, the cable connector assembly includes a plurality of signal cables and a plurality of non-signal cables, wherein a rear end of the first core of each of the signal cables is located behind a rear end of the second core of each of the non-signal cables.

In certain embodiments, a rear end of the second core is flush with a rear end of the shielding layer or is located in front of the rear end of the shielding layer.

In certain embodiments, the cable connector assembly includes a plurality of signal terminals, wherein the signal terminals comprise three terminal pairs, and the shielding sheet has three soldering portions respectively corresponding to the first wire-bonding ends of the three terminal pairs.

In certain embodiments, the non-signal terminal comprises a grounding terminal, and the shielding sheet has a plurality of soldering portions, wherein one of the soldering portions corresponds to the second wire-bonding end of the grounding terminal.

In certain embodiments, the non-signal cable comprises a grounding cable, and the second soldering portion of the grounding cable is soldered to the one of the soldering portions corresponds to the second wire-bonding end of the grounding terminal.

In certain embodiments, the first core comprises a high-speed signal core and a universal serial bus (USB) 2.0 core, and the second core comprises a grounding core and a power core, wherein a diameter of the power core is greater than a diameter of the high-speed signal core, the diameter of the high-speed signal core is greater than or equal to a diameter of the grounding core, and the diameter of the grounding core is greater than or equal to a diameter of the USB 2.0 core.

In certain embodiments, the terminals are arranged symmetrically in an upper row and a lower row, and the shielding sheet is arranged between the terminals in the upper row and the lower row.

In certain embodiments, the non-signal terminal comprises two grounding terminals, and two second wire-bonding ends of the two grounding terminals are connected to each other through a connecting frame.

In certain embodiments, the connecting frame has a bending portion electrically connected with the soldering portion.

In certain embodiments, the shielding layer is electrically connected with the connecting frame.

In certain embodiments, the non-signal terminal comprises a grounding terminal and a power terminal, and a front end of the second wire-bonding end of the grounding terminal is located between a front end of the first wire-bonding end and a front end of the second wire-bonding end of the power terminal.

In certain embodiments, the shielding sheet has a plurality of soldering portions, and a front end of at least one of the first wire-bonding end and the second wire-bonding end is located in front of a front end of at least one of the soldering portions.

In certain embodiments, the shielding layer is soldered to the soldering portion by laser soldering.

In certain embodiments, the body has a base, a first extending portion is formed by extending forward from the base, the first wire-bonding end is arranged on an upper surface of the first extending portion, a second extending portion is formed by extending forward from the base, and the second wire-bonding end is arranged on an upper surface of the second extending portion.

In certain embodiments, a front end of the first wire-bonding end is flush with a front end of the first extending portion, and a front end of the second wire-bonding end is flush with a front end of the second extending portion.

Compared with the related art, certain embodiments of the invention have the following beneficial advantages: the second insulating layer and the contact area are arranged in tandem to be staggered with each other, in a subsequent process of soldering the contact area by laser soldering, the second insulating layer is not melted by heat and damaged, thereby ensuring its insulating effect. The second soldering portion is flush with the shielding layer, such that both can be continuously soldered in the subsequent process of laser soldering, thereby increasing the efficiency of soldering These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
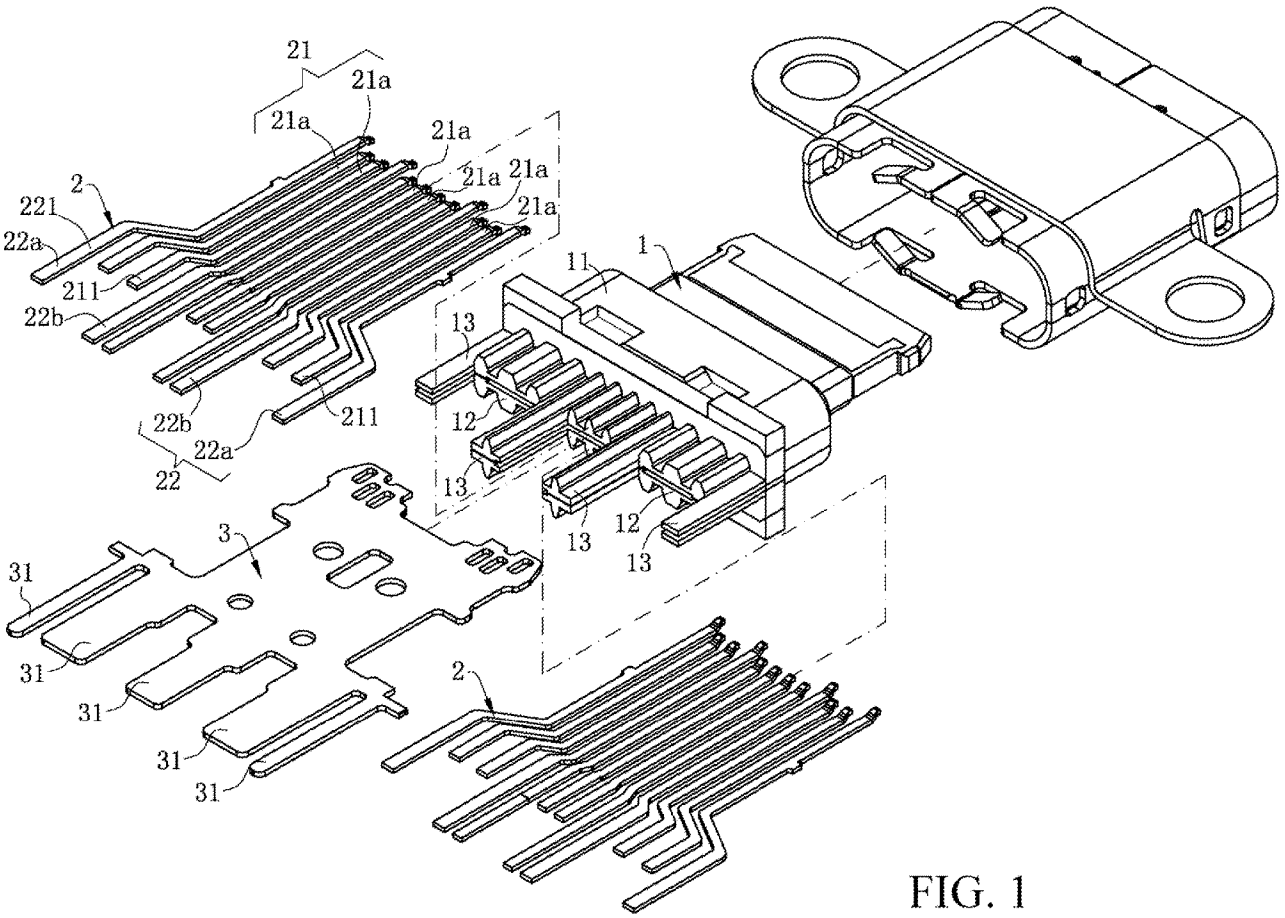
FIG. 1 is a partial exploded view of the cable connector assembly according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to a cable connector assembly.

Figure 2:
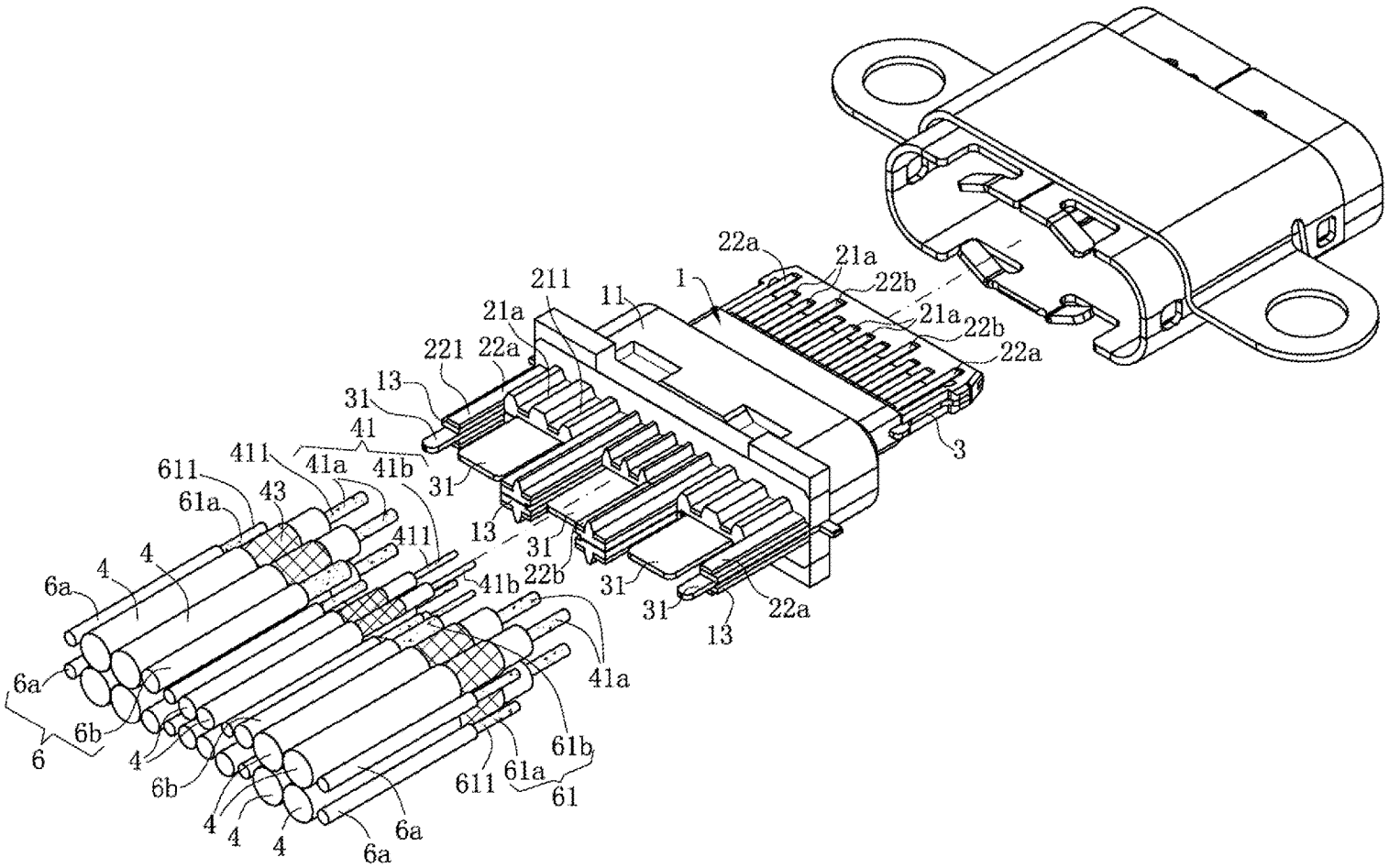
FIG. 2 is a three-dimensional exploded view of the cable connector assembly according to the first embodiment of the present invention.
Figure 3:
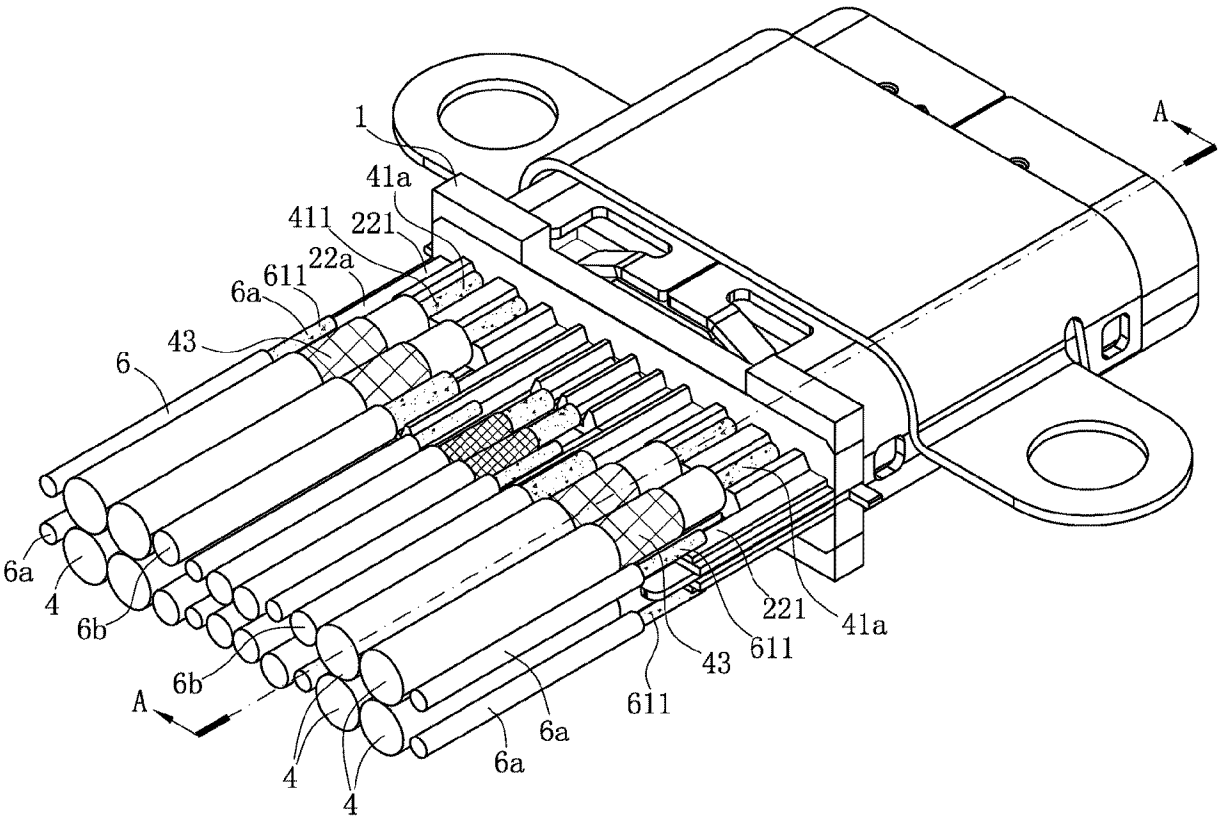
FIG. 3 is a three-dimensional view of the cable connector assembly according to the first embodiment of the present invention.

As shown in FIG. 1 to FIG. 3, a cable connector assembly 100 according to a first embodiment of the present invention is provided. The cable connector assembly 100 includes: a body 1; a plurality of terminals 2 accommodated in the body 1, the terminals 2 including a plurality of signal terminals 21 and a plurality of non-signal terminals 22, each signal terminal 21 having a first wire-bonding end 211 that horizontally extends forward outside the body 1, and each non-signal terminal 22 having a second wire-bonding end 221 that extends outside the body 1 along a same direction as the first wire-bonding end 211; a shielding sheet 3 arranged on the body 1, the shielding sheet 3 having a soldering portion 31 which extends outside the body 1 along the same direction as the first wire-bonding end 211; a signal cable 4 having a first core 41, a first insulating layer 42 wrapping on the first core 41, and a shielding layer 43 wrapping on the first insulating layer 42, the first core 41 having a first soldering portion 411 that is exposed from the first insulating layer 42 and configured to be soldered to the first wire-bonding end 211; and a non-signal cable 6, having a second core 61 and a second insulating layer 62 wrapping on the second core 61, and the second core 61 having a second soldering portion 611 that is exposed from the second insulating layer 62 and configured to be soldered to the second wire-bonding end 221.

Figure 4:
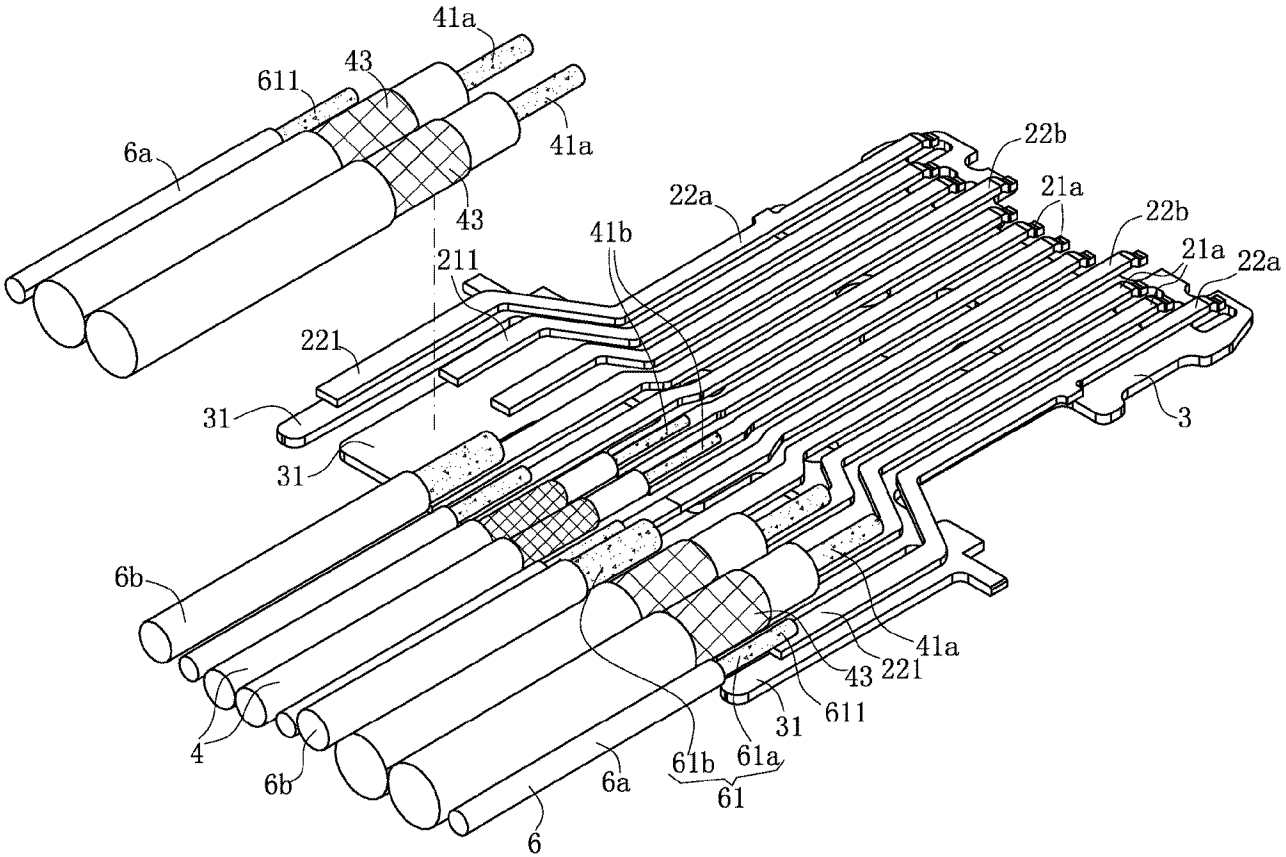
FIG. 4 is a schematic view of the soldering between terminals and cables of the cable connector assembly according to the first embodiment of the present invention.
Figure 5:
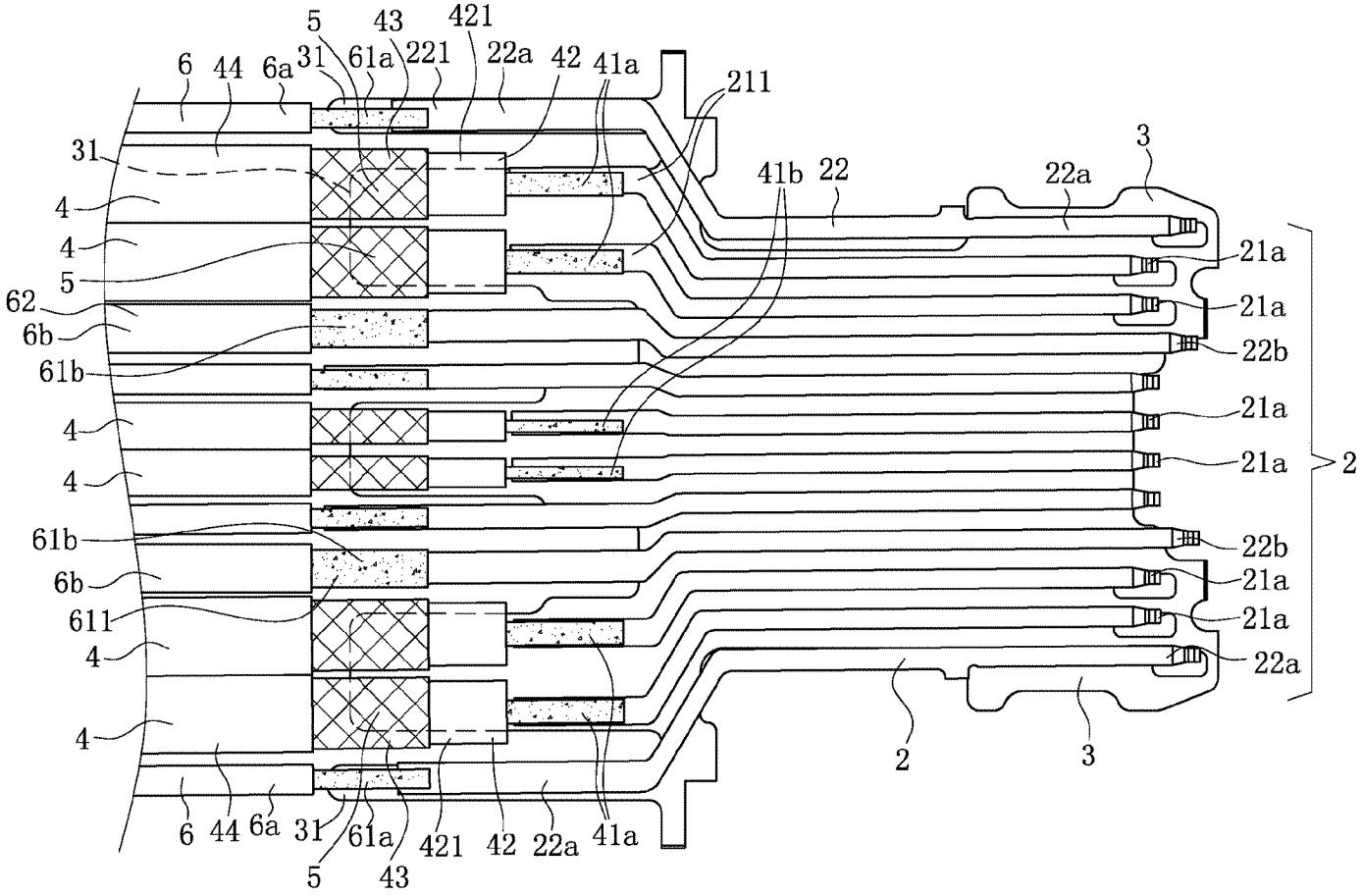
FIG. 5 is a top view of the soldering between terminals and cables of the cable connector assembly according to the first embodiment of the present invention.

As shown in FIG. 4 and FIG. 5, the number of signal terminals 21 is six, and they are arranged as three terminal pairs 21*a*. The shielding sheet 3 has three soldering portions 31 which respectively correspond to the first wire-bonding ends 211 of the three terminal pairs 21*a*. The non-signal terminals 22 include two grounding terminals 22*a*, and the shielding sheet 3 has two soldering portions 31 which respectively correspond to two second wire-bonding ends 221 of the two grounding terminals 22*a*. Corresponding to the six signal terminals 21, the number of the first cores 41 is six, arranged as three pairs, which include two pairs of high-speed signal cores 41*a* and a pair of USB 2.0 cores 41*b*. The non-signal cables 6 include two grounding cables 6*a*, two power cables 6*b* and two reserved cables (not numbered). A diameter of a power core 61*b* of each power cable 6*b* is greater than a diameter of each high-speed signal core 41*a*. The diameter of each high-speed signal core 41*a* is greater than or equal to a diameter of a grounding core 61*a* of each grounding cable 6*a*. The diameter of each grounding core 61*a* is greater than or equal to a diameter of each USB 2.0 core 41*b*. The rear ends of the six first cores 41 are all located behind the rear ends of the second cores 61. In other embodiments, the diameter of each high-speed signal core 41*a* can be equal to the diameter of the grounding core 61*a* of each grounding cable 6*a*, and the diameter of each grounding core 61*a* can also be equal to the diameter of each USB 2.0 core 41*b*.

Figure 6:
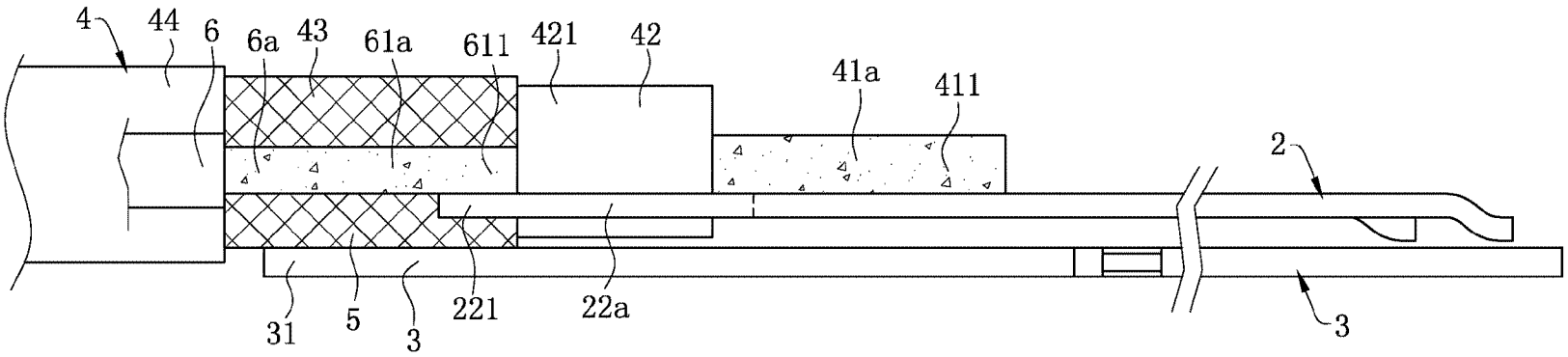
FIG. 6 is a side view of FIG. 5.

As shown in FIG. 4 to FIG. 6, the shielding layer 43 is electrically connected with the soldering portion 31 to form a contact area 5, and the contact area 5 is soldered by laser soldering, thereby fixing the shielding layer 43 to the soldering portion 31. The non-signal cables 6 include two grounding cables 6*a* and two power cables 6*b*. The second insulating layers 62 of all of the non-signal cables 6 are located in front of the contact areas 5. Since laser soldering can result in high temperature, such arrangement staggers the second insulating layers 62 and the contact areas 5 in tandem. Consequently, in the process of soldering the contact areas 5 by laser soldering, the second insulating layers 62 of the non-signal cables 6, such as the grounding cables 6*a* or the power cables 6*b*, near the contact areas 5 will not be melted by the high temperature to expose the second cores 61 which is supposed to be wrapped therein, resulting in the risk of short-circuiting or electrical leakage. In other embodiments, it is reasonable that the rear ends of the second insulating layers 62 are flush with the front end of the contact areas 5. The rear ends of the second cores 61 are flush with the rear ends of the shielding layers 43, a third insulating layer 44 wraps on the shielding layer 43, and the rear ends of the third insulating layers 44 are flush with the rear ends of the second insulating layers 62. The reason for such arrangement is that the first insulating layer 42 of the signal cable 4 is usually provided with an exposed section 421, in order to prevent the first core 41 from being short-circuited with the shielding layer 43. However, because the exposed sections 421 are normally flush with the second cores 61, in the process of laser soldering of the second cores 61, the exposed sections 421 can also be easily melted by heat to result in the risk of short-circuiting or electrical leakage. It should be noted that in other embodiments, the same objective can be achieved when the rear ends of the second cores 61 are located in front of the rear ends of the shielding layers 43. Similarly, the intention of the present invention can also be met when the rear ends of the third insulating layers 44 are located in front of the rear ends of the second insulating layers 62.

Figure 7:
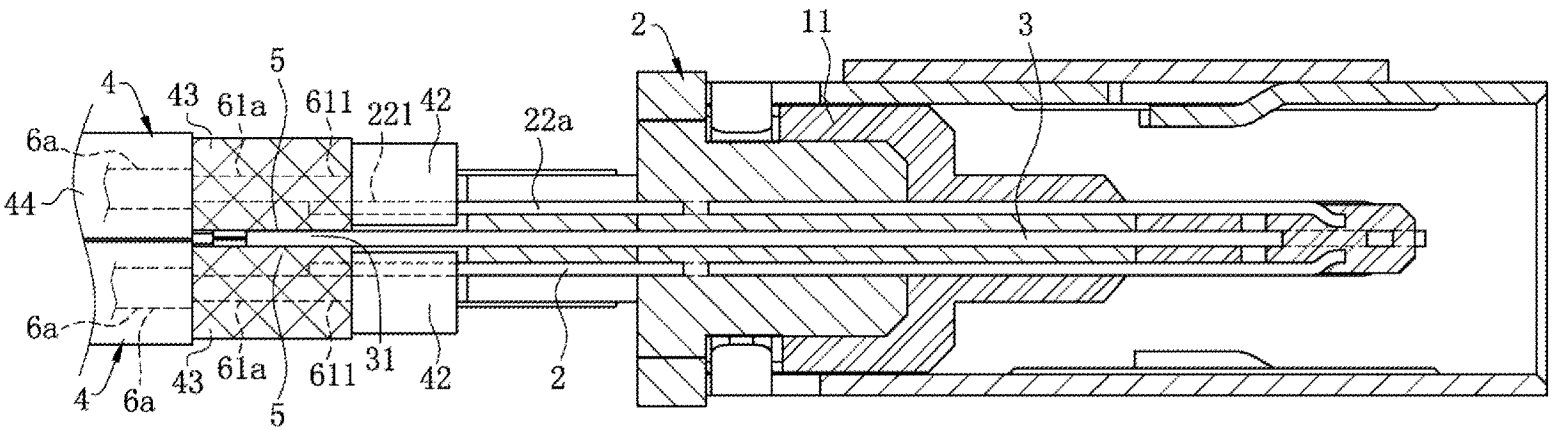
FIG. 7 is a sectional view of FIG. 3 in an A-A direction.

As shown in FIG. 2 and FIG. 7, the body 1 has a base 11, the base 11 extends forward to form three first extending portions 12 and four second extending portions 13 respectively separated by the three first extending portions 12. The terminals 2 are arranged on the base 11 symmetrically in an upper row and a lower row. The first wire-bonding ends 211 are exposed on upper and lower surfaces of the first extending portions 12, and the second wire-bonding ends 221 are exposed on upper and lower surfaces of the second extending portions 13. The shielding sheet 3 is arranged between the terminals 2 in the upper row and the lower row. The three soldering portions 31 are sandwiched between the first wire-bonding ends 211 of the six terminal pairs 21*a* in the upper row and in the lower row, respectively. The front ends of the second wire-bonding ends 221 of the grounding terminals 22*a* are located between the front ends of the first wire-bonding ends 211 and the front ends of the second wire-bonding ends 221 of the power terminals 22*b*. Meanwhile, the front ends of the first wire-bonding ends 211 are flush with the front ends of the first extending portions 12, and the front ends of the second wire-bonding ends 221 are flush with the front ends of the second extending portions 13. The shielding sheet 3 also has two soldering portions 31 which are sandwiched between the second wire-bonding ends 221 of the four grounding terminals 22*a* in the upper row and in the lower row, respectively. The front ends of the two soldering portions 31 partially protrude outside the second extending portions 13. The grounding cores 61*a* are soldered to the grounding terminals 22*a* by laser soldering, and the grounding cores 61*a* can also be soldered to the two soldering portions 31 at the same time.

Figure 8:
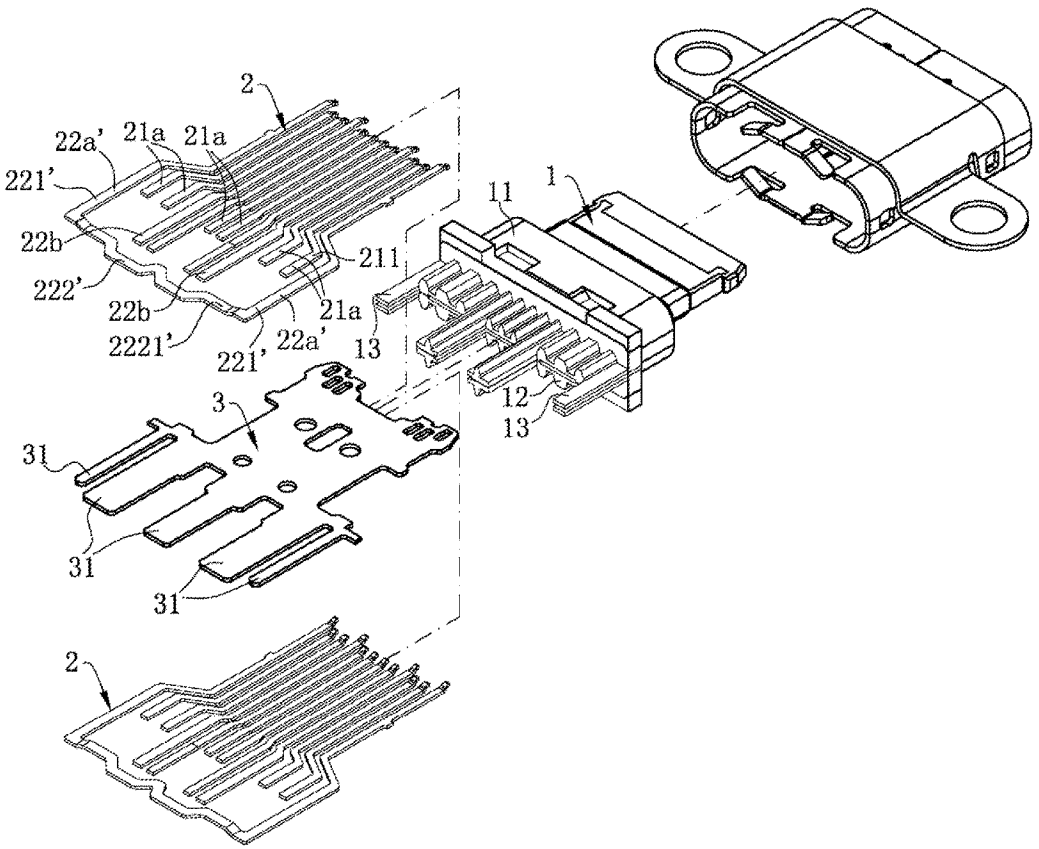
FIG. 8 is a partial exploded view of the cable connector assembly according to a second embodiment of the present invention.
Figure 9:
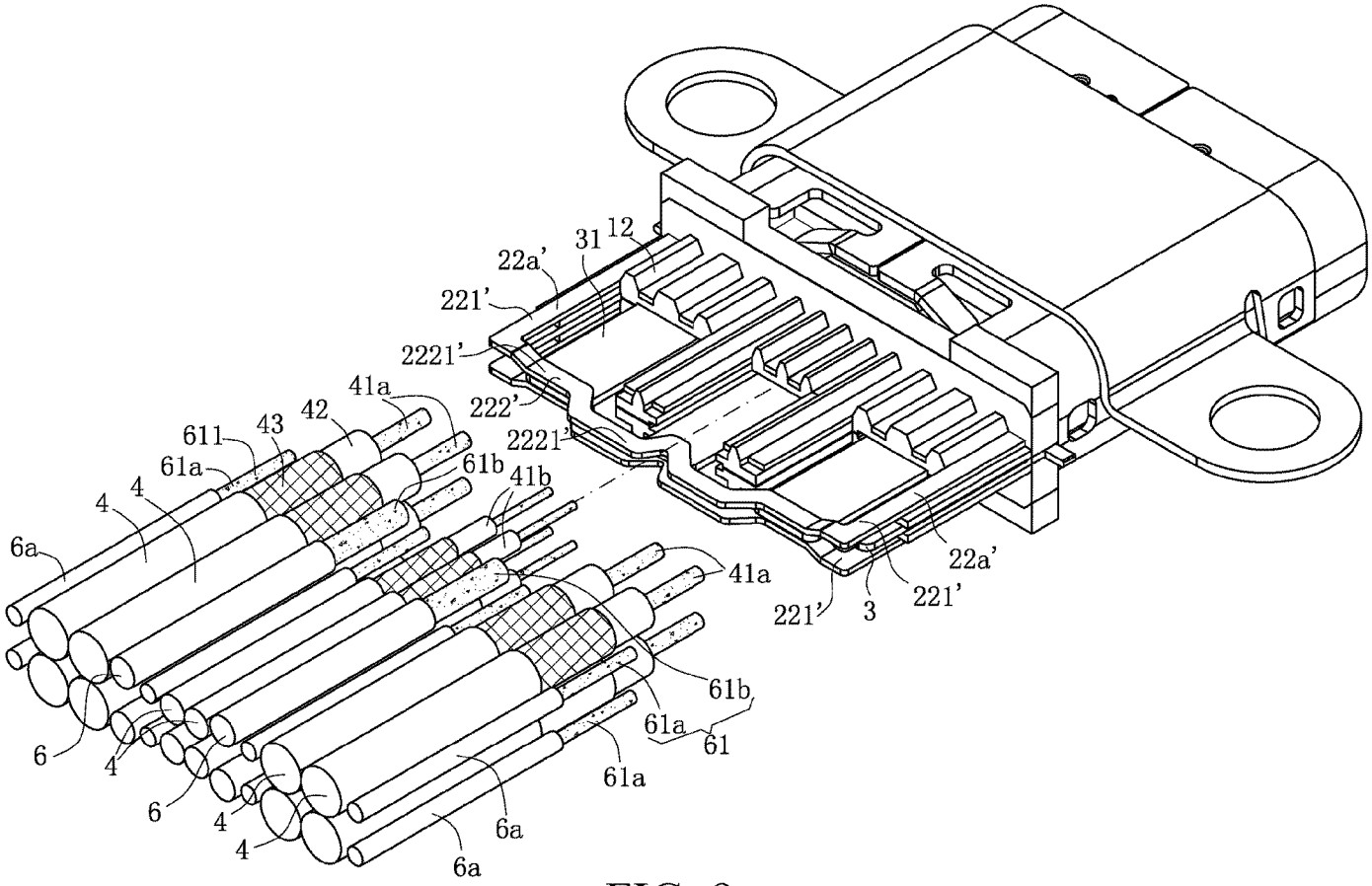
FIG. 9 is a three-dimensional exploded view of the cable connector assembly according to the second embodiment of the present invention.
Figure 10:
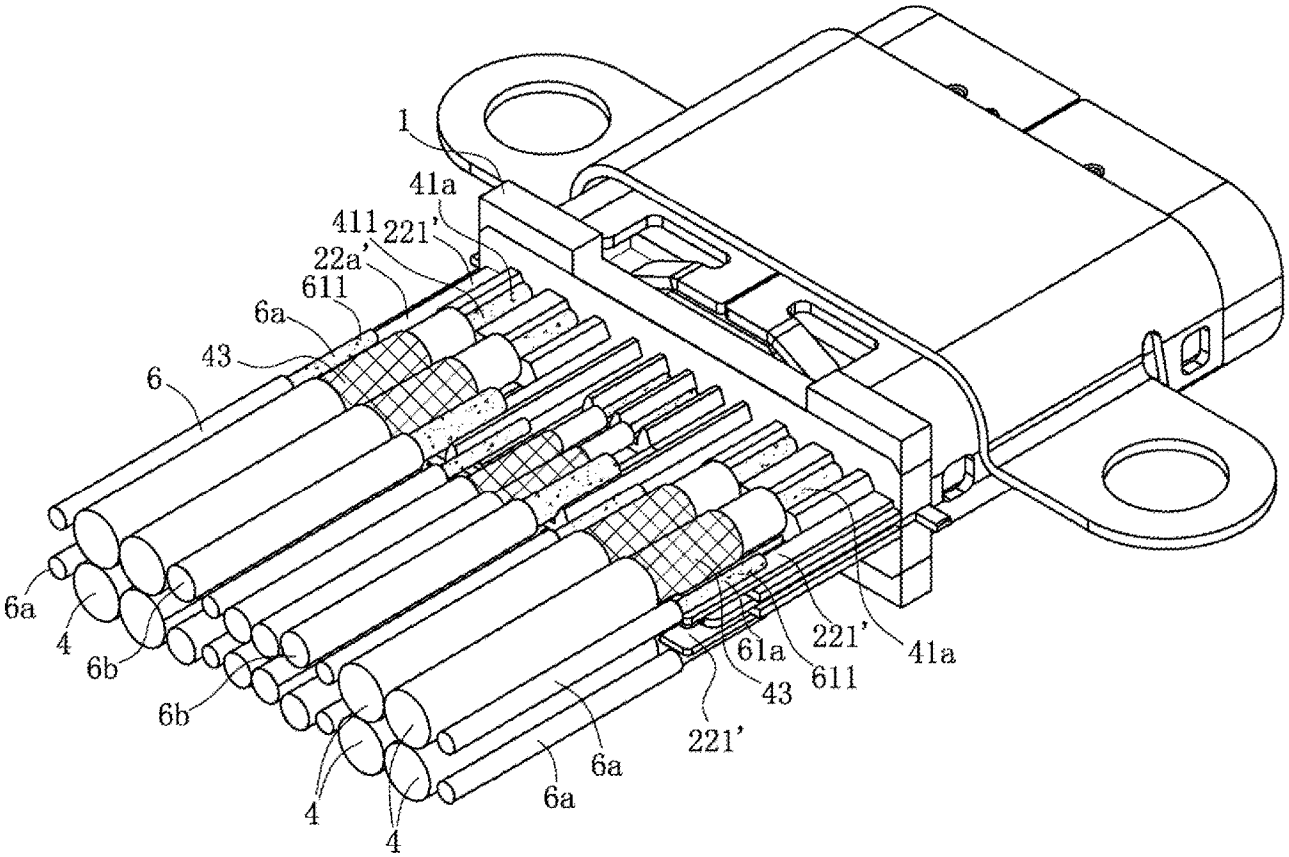
FIG. 10 is a three-dimensional view of the cable connector assembly according to the second embodiment of the present invention.

As shown in FIG. 8 to FIG. 10, a cable connector assembly 100 according to a second embodiment of the present invention is provided. The second embodiment differs from the first embodiment in that the two second wire-bonding ends 221' of the two grounding terminals 22*a*' in the same row are electrically connected through a connecting frame 222', and the connecting frame 222' and the two second wire-bonding ends 221' are integrally provided, thus enhancing the grounding performance of the grounding terminals 22*a'*.

Figure 11:
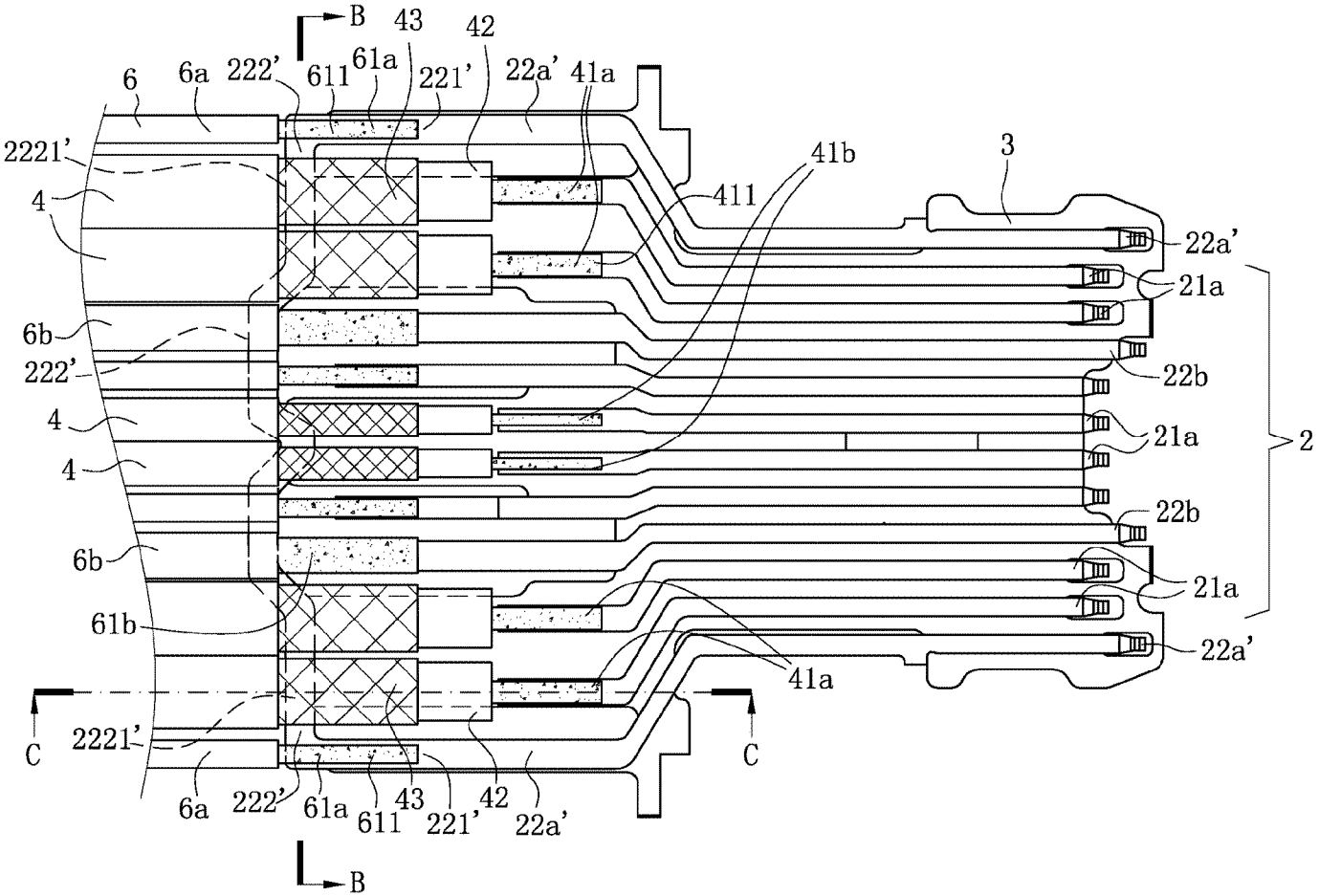
FIG. 11 is a top view of the soldering between terminals and cables of the cable connector assembly according to the second embodiment of the present invention.
Figure 12:
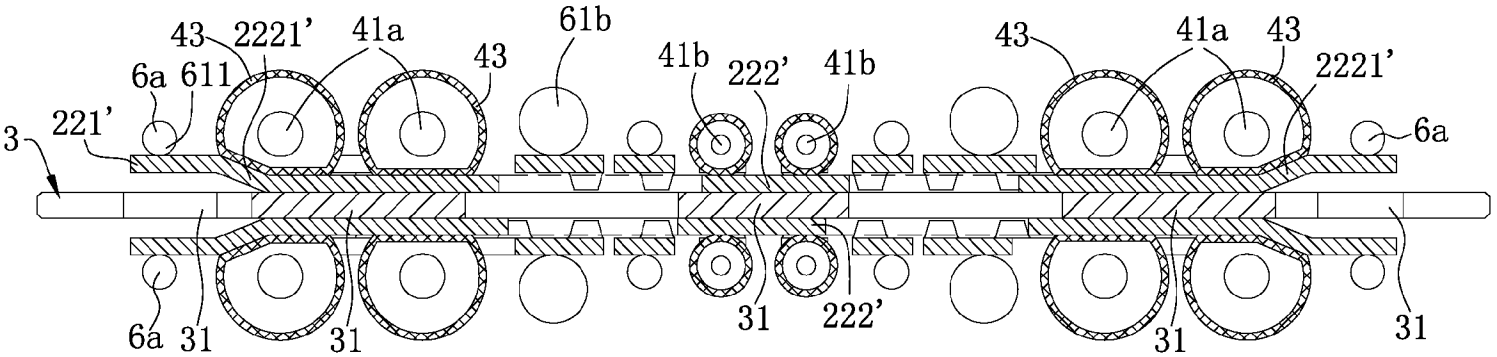
FIG. 12 is a sectional view of FIG. 11 in a B-B direction.
Figure 13:
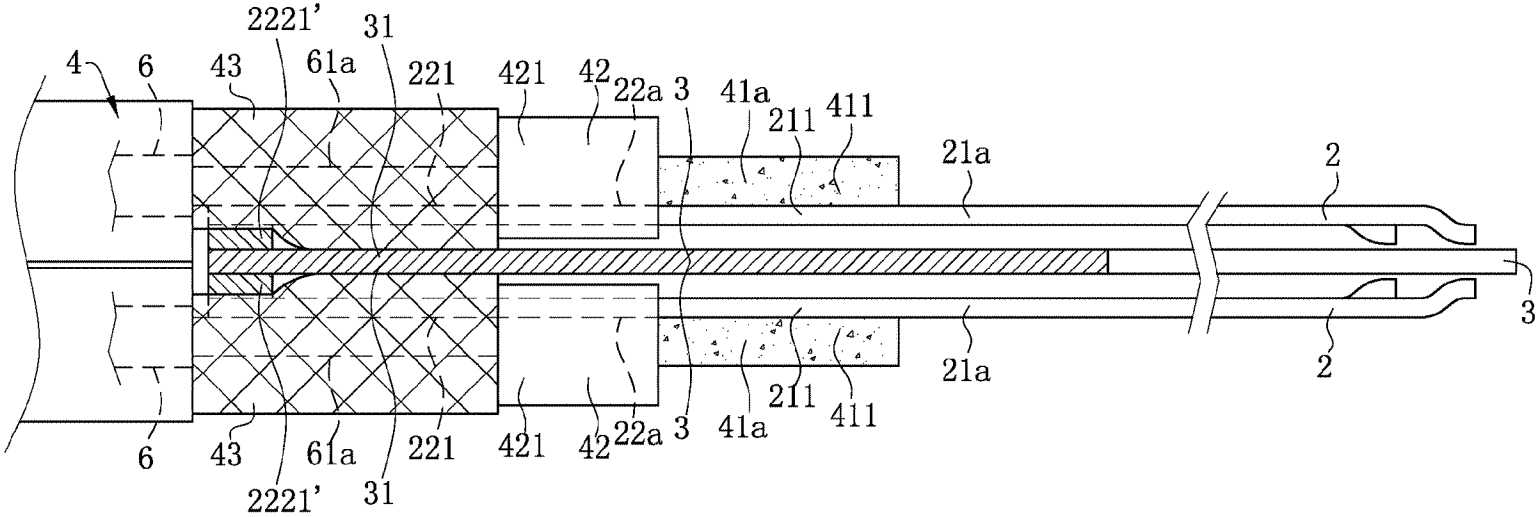
FIG. 13 is a sectional view of FIG. 11 in a C-C direction.

As shown in FIG. 11 to FIG. 13, the connecting frame 222' has a bending portion 2221'. The bending portion 2221' is electrically connected with the three soldering portions 31 corresponding to the terminal pairs 21*a*. The shielding layers 43 are electrically connected with the connecting frame 222'. Since the shielding layers 43 are also soldered to the three soldering portions 31 by laser soldering, the bending portion 2221', the three soldering portions 31 and the shielding layers 43 are electrically connected with one another. Certainly, any two of the three components can be soldered to be connected with each other, so that the grounding terminals 22*a'*, the shielding sheet 3 and the shielding layers 43 are electrically conductive with each other, forming an integral shielding structure (not numbered), thereby considerably enhancing the shielding effect of the cable connector assembly 100. This also makes the front ends of the second wire-bonding ends 221 be not flush with the front ends of the second extending portions 13. Moreover, in the present embodiment, the front ends of the first wire-bonding ends 211 are located behind the front ends of the first extending portions 12. The other structures in the second embodiment are identical with those in the first embodiment, and therefore the descriptions thereof are not elaborated herein.

In the above-mentioned two embodiments, the shielding sheet 3 horizontally protrudes forward outside the body 1. In other embodiments, the shielding sheet 3 can be bent by 90 degrees or other angles to protrude outside the body 1. Correspondingly, the first wire-bonding ends 211 and the second wire-bonding ends 221 can be modified in the same way. In such ways, arrangements can be customized according to different application requirements, thereby allowing the cable connector assembly 100 of the present invention to have good adaptability to spatial conditions.

A cable connector assembly according to certain embodiments of the present invention have the following beneficial advantages:

1. The shielding layer 43 is electrically connected with the soldering portion 31, thereby enhancing the grounding effect of the cable connector assembly. The contact area 5 and the second insulating layer 62 are staggered in tandem, such that in the subsequent process of laser soldering of the contact area 5, the second insulating layer 62 is not damaged, thereby ensuring the insulating effect, and avoiding from short-circuiting. Moreover, the second soldering portion 611 is flush with the shielding layer 43, such that the subsequent processes of laser soldering of the second soldering portion 611 and the second wire-bonding end 221 as well as laser soldering of the shielding layer 43 and the soldering portion 31 can be continuously performed, thus increasing the efficiency of soldering.

2. The grounding core 61*a* is soldered to both the second wire-bonding end 221 of the grounding terminal 22*a* and the soldering portion 31, so that the shielding layer 43 is electrically conductive with the grounding terminal 22*a* and the grounding core 61*a* through the shielding sheet 3, thus enhancing the grounding effect of the cable connector assembly 100.

3. The connecting frame 222' encloses the first wire-bonding ends 211 and second wire-bonding ends 221' of all of the terminals 2, and the bending portion 2221' is electrically connected with the soldering portions 31, so that the grounding terminals 22*a'* are directly conductive with the shielding sheet 3. The shielding layers 43 are soldered to the bending portion 2221', thus enhancing the shielding effect of the cable connector assembly 100, and alleviating crosstalk interference.

4. The second soldering portions 611 and the exposed sections 421 are staggered in tandem, so that heat generated in the process of laser soldering of the second soldering portions 611 does not melt the exposed sections 421 to cause the portions of the first cores 41 that are supposed to be wrapped to be exposed, thus preventing the risk of short-circuiting caused thereby.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable connector assembly, comprising:

a body;

a plurality of terminals, comprising: a signal terminal having a first wire-bonding end extending outside the body; and a non-signal terminal having a second wire-bonding end extending outside the body along a same direction as the first wire-bonding end;

a shielding sheet, provided on the body, and having a soldering portion extending outside the body along the same direction as the first wire-bonding end;

a signal cable, having a first core, a first insulating layer wrapping on the first core, and a shielding layer wrapping on the first insulating layer, wherein the first core has a first soldering portion exposed from the first insulating layer and configured to be soldered to the first wire-bonding end, and the shielding layer is electrically connected with the soldering portion to form a contact area; and a non-signal cable, having a second core and a second insulating layer wrapping on the second core, wherein the second core has a second soldering portion exposed from the second insulating layer and configured to be soldered to the second wire-bonding end, and in an extending direction of the soldering portion, a front end of the contact area is flush with a rear end of the second insulating layer or is located behind the rear end of the second insulating layer.

2. The cable connector assembly according to claim 1, wherein a third insulating layer wraps on the shielding layer, and a rear end of the third insulating layer is flush with the rear end of the second insulating layer or is located in front of the rear end of the second insulating layer.

3. The cable connector assembly according to claim 1, comprising a plurality of signal cables and a plurality of non-signal cables, wherein a rear end of the first core of each of the signal cables is located behind a rear end of the second core of each of the non-signal cables.

4. The cable connector assembly according to claim 1, wherein a rear end of the second core is flush with a rear end of the shielding layer or is located in front of the rear end of the shielding layer.

5. The cable connector assembly according to claim 1, comprising a plurality of signal terminals, wherein the signal terminals comprise three terminal pairs, and the shielding sheet has three soldering portions respectively corresponding to the first wire-bonding ends of the three terminal pairs.

6. The cable connector assembly according to claim 1, wherein the non-signal terminal comprises a grounding terminal, and the shielding sheet has a plurality of soldering portions, wherein one of the soldering portions corresponds to the second wire-bonding end of the grounding terminal.

7. The cable connector assembly according to claim 6, wherein the non-signal cable comprises a grounding cable, and the second soldering portion of the grounding cable is soldered to the one of the soldering portions corresponds to the second wire-bonding end of the grounding terminal.

8. The cable connector assembly according to claim 1, wherein the first core comprises a high-speed signal core and a universal serial bus (USB) 2.0 core, and the second core comprises a grounding core and a power core, wherein a diameter of the power core is greater than a diameter of the high-speed signal core, the diameter of the high-speed signal core is greater than or equal to a diameter of the grounding core, and the diameter of the grounding core is greater than or equal to a diameter of the USB 2.0 core.

9. The cable connector assembly according to claim 1, wherein the terminals are arranged symmetrically in an upper row and a lower row, and the shielding sheet is arranged between the terminals in the upper row and the lower row.

10. The cable connector assembly according to claim 1, wherein the non-signal terminal comprises two grounding terminals, and two second wire-bonding ends of the two grounding terminals are connected to each other through a connecting frame.

11. The cable connector assembly according to claim 10, wherein the connecting frame has a bending portion electrically connected with the soldering portion.

12. The cable connector assembly according to claim 10, wherein the shielding layer is electrically connected with the connecting frame.

13. The cable connector assembly according to claim 1, wherein the non-signal terminal comprises a grounding terminal and a power terminal, and a front end of the second wire-bonding end of the grounding terminal is located between a front end of the first wire-bonding end and a front end of the second wire-bonding end of the power terminal.

14. The cable connector assembly according to claim 1, wherein the shielding sheet has a plurality of soldering portions, and a front end of at least one of the first wire-bonding end and the second wire-bonding end is located in front of a front end of at least one of the soldering portions.

15. The cable connector assembly according to claim 1, wherein the shielding layer is soldered to the soldering portion by laser soldering.

16. The cable connector assembly according to claim 1, wherein the body has a base, a first extending portion is formed by extending forward from the base, the first wire-bonding end is arranged on an upper surface of the first extending portion, a second extending portion is formed by extending forward from the base, and the second wire-bonding end is arranged on an upper surface of the second extending portion.

17. The cable connector assembly according to claim 16, wherein a front end of the first wire-bonding end is flush with a front end of the first extending portion, and a front end of the second wire-bonding end is flush with a front end of the second extending portion.

* * * * *